United States Patent [19]

Conally

[11] Patent Number: 4,776,775

[45] Date of Patent: Oct. 11, 1988

[54] CHEMICAL INJECTOR PUMP

[75] Inventor: Harlew Conally, Corpus Christi, Tex.

[73] Assignee: TXAM Chemical Pumps, Inc., Corpus Christi, Tex.

[21] Appl. No.: 148,772

[22] Filed: Jan. 26, 1988

Related U.S. Application Data

[63] Continuation of Ser. No. 905,768, Sep. 10, 1986, abandoned.

[51] Int. Cl.[4] ..... F04B 17/00; F04B 35/00

[52] U.S. Cl. ..... 417/401; 417/510; 91/347

[58] Field of Search ..... 417/510, 401, 402; 91/347; 137/596.14, 596.18

[56] References Cited

U.S. PATENT DOCUMENTS

| | | | |
|---|---|---|---|
| 2,631,573 | 3/1953 | Levitt et al. | 91/347 |
| 2,887,094 | 5/1959 | Krukemeier | 91/271 |
| 3,019,734 | 2/1962 | Bourquin | 91/347 |
| 3,118,390 | 1/1964 | Kinsley | 417/510 |
| 3,589,839 | 6/1971 | Johnson | 417/401 |
| 3,749,527 | 7/1973 | Slage | 417/402 |
| 3,807,448 | 4/1974 | Hadden | 137/596.14 |
| 3,814,548 | 6/1974 | Rupp | 417/395 |
| 4,645,431 | 2/1987 | Spencer | 417/401 |

OTHER PUBLICATIONS

Texstream Corp. Pump Catalog & Parts List for Series 5000 injectors, 3700 injectors, 5700 injectors, 6000 pumps, 6100 pumps.

Morgan Products Pneumatic Chemical injectors

*Primary Examiner*—William L. Freeh

*Attorney, Agent, or Firm*—G. Turner Moller

[57] ABSTRACT

The liquid pressure capacity of a chemical injector pump is increased substantially by using high pressure gas to drive the gas motor. In one embodiment, the chemical injector pump includes a liquid pump end, a gas motor end, a low pressure position responsive valve, and a high pressure pilot operated valve manipulated by the low pressure valve for delivering high pressure gas to the gas motor. In other embodiments, the chemical injector pump includes a liquid pump end, a gas motor end, and a high pressure position responsive valve for directly delivering high pressure gas to the gas motor.

14 Claims, 5 Drawing Sheets

FIG 7
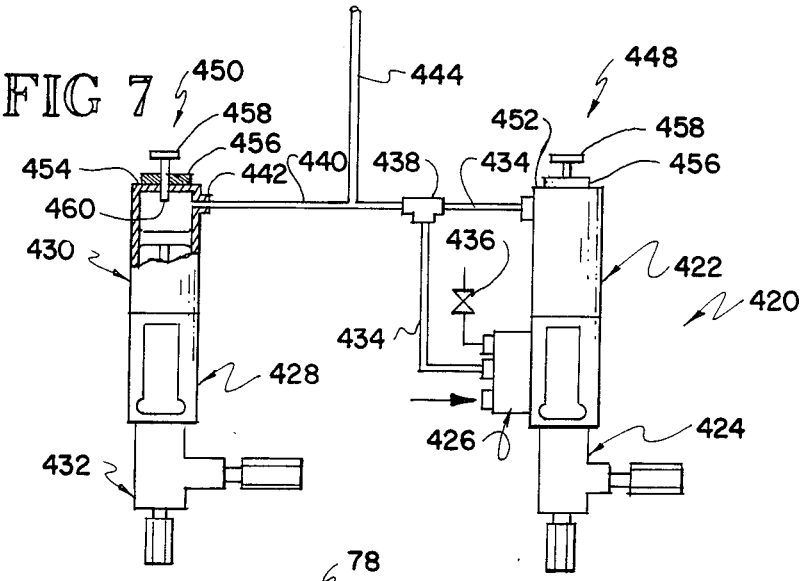
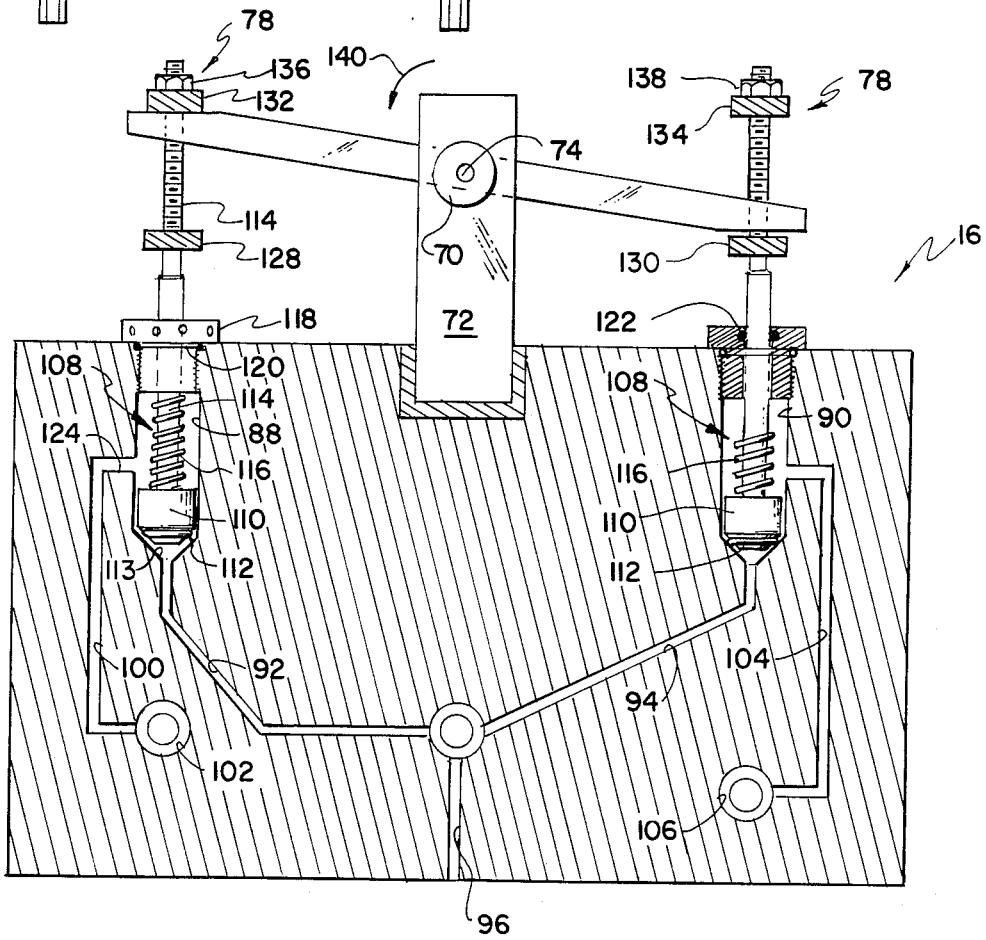
FIG 4

CHEMICAL INJECTOR PUMP

This application is a continuation of application Ser. No. 06/905,768, filed Sept. 10, 1986, now abandoned.

This invention relates to improved chemical injector pumps and more particularly to high pressure, low volume pumps of the type typically used to inject liquid chemicals into pipelines or flowlines transporting natural gas, petroleum products and the like.

High pressure, low volume chemical injector pumps have been used widely in the oil field to inject various liquid chemical into pipelines transporting high pressure natural gas. For example, many high pressure, high volume gas wells have a tendency to freeze up downstream of the production choke located in the Christmas tree. A typical well flowing 5,000 MCFD of gas through a 14/64" choke will show a pressure upstream of the choke of about 4490 psi and a downstream pressure of about 950 psi. If such a well had a flowing temperature of 180° F. upstream of the choke, the temperature downstream of the choke will be about 40° F. A temperature this low will cause hydrates to form in the gas line downstream of the choke. Hydrates are solid or semi-solid ice-like accumulations composed of hydrocarbons and water. To eliminate or minimize the formation of hydrates downstream of the choke, the typical production practice is to inject small quantities of methanol or glycol into the flow line downstream of the choke in a more-or-less continuous basis.

Another common use of chemical injection pumps in the oil field is the injection of corrosion inhibitors into the flow line. Such inhibitors suppress corrosion in metal production equipment by forming a film on the metal parts thereof.

Chemical injection pumps of this type are typically driven by relatively low pressure gas such as compressed air or natural gas which is taken off the flow line or separator and delivered through a regulator to reduce the pressure thereof to a desired value. Thus, chemical injection pumps of the type related to this invention include a relatively small diameter high pressure liquid pump end and a relatively large diameter low pressure gas motor end. The gas end typically includes a piston or a diaphragm which is driven by the low pressure natural gas and which, in turn, drives the small liquid pump end.

There is an obvious relationship between the sizes and pressure capacities of the pump and motor ends of chemical injectors of the type contemplated by the invention. For example, if the pump end includes a piston ¼" in diameter and is expected to pump liquid against a 5,000 psi backpressure, the force acting against the pump piston is equal to:

$$\begin{aligned} F &= \text{pressure} \times \text{area} \\ &= 5{,}000\ \#/\text{sq in} \times (3.1417)(.125)(.125)\ \text{sq in} \\ &= 245\ \text{pounds.} \end{aligned}$$

Thus, to operate the chemical injector, the motor end must produce a force in excess of 245 pounds. If the motor end of a particular injector is a diaphragm 5" in diameter, the pressure applied thereto must be at least:

$$F = \text{pressure} \times \text{area}$$

$$245\ \text{pounds} = P \times (3.1417)(2.5)(2.5)$$

-continued $$\begin{aligned} P &= 245\ \text{pounds}/19.64\ \text{sq in} \\ &= 12.47\ \text{psi.} \end{aligned}$$

This value, in reality, is the pressure differential required across the gas motor piston or diaphragm. Often, gas pushed out of the gas motor end is throttled to control the speed of the pump which means that the pressure on the inlet side of the gas motor must be higher. In addition, the actual gas pressure required to operate a ¼" pump against a 5000 psi back pressure is substantially greater than 12.47 psi because of friction.

If one wants to increase the pressure of the liquid pumped by a chemical injector, one has only three broad choices: (1) use a smaller diameter pump, which decreases the amount of liquid pumped in every cycle of the pump but which allows the pump to deliver higher pressure; (2) use a larger diameter gas motor end which increases the pressure capacity of the injector and (3) use higher pressure gas to drive the gas motor. The standard approach of the industry is to use a smaller liquid end, i.e. (1). If the volume delivered by the smaller pump end is inadequate, the injector is either run faster or multiple injectors are used to provide the necessary volume. The industry also provides chemical injectors of various sizes, which means that (2) is also widely practiced.

Typical chemical injector pumps are found in U.S. Pat. Nos. 2,426,320; 3,093,122; 3,282,167; 3,327,635; 4,104,008; 4,452,573 and publications of TXT-Texsteam entitled "Pump Catalog & Parts List" for chemical injectors of Series 3700, 5000 and 5100.

As will be more fully apparent hereinafter, the broad approach of this invention is to deliver higher pressure gas to the gas motor. This approach is particularly appealing because very high pressure natural gas is always present in the production situation mentioned above. In addition, the increase of gas pressure from 50 psi to 100 psi does not require an extensive redesign of the gas motor end but it does double the outlet pressure capacity of the liquid pump end which might be from 5,000 psi to 10,000 psi or 10,000 psi to 20,000 psi. In other words, the increase in pressure at the gas motor end is not significant but the increase in pressure at the liquid pump end is very significant.

Thus, this invention contemplates a chemical injector having a more-or-less conventional gas motor end, a more-or-less conventional liquid pump end and an improved gas distribution system for delivering high pressure gas to the gas motor end. It is not sufficient for the gas distribution system of a chemical injector to work satisfactorily under laboratory conditions ore for a short period of time. It is necessary for chemical injectors to work in the field under conditions which are either too hot, too cold, too wet, too dry, too dusty, and too far from town for a long period of time without substantial maintenance or attention. Chemical injectors operate at different speeds, usually reported in cycles/minute. Speeds of 10–30 cycles per minute are quite normal. At 20 cycles/minute, a chemical injector will undergo: 20 cycles/minute×60 minutes per hour×24 hours/day×30 days/month=864,000 cycles in a month. It is not unusual for an operator to expect a chemical injector to operate for six months without an overhaul. This is obviously in excess of 5,000,000 operating cycles.

Making anything that will operate for 5,000,000 cycles without breaking down is no small feat.

Two basic embodiments of the invention are disclosed. In the first embodiment, reciprocation of the output rod of the gas motor manipulates a low pressure valve which delivered control air or natural gas to a pilot operated valve. The pilot operated valve is manipulated to deliver high pressure air or natural gas to the gas motor. In the return cycle, the pilot operated valve delivers exhaust air from the gas motor to a vent outlet which is conveniently throttled to control the speed of operation of the chemical injector pump. In this embodiment, existing liquid pump ends, gas motor ends, and low pressure valves may be incorporated with a new pilot operated valve to provide chemical injector pumps having substantially increased pressure capacities.

In a second embodiment of the invention, high pressure air or natural gas is controlled directly by a position responsive valve to directly deliver high pressure gas to the gas motor end and to control the exhaust of gas from the gas motor end. In the second embodiment, a spring is used to return the fluid operated power element in the gas motor to its starting position. In a modification of the second embodiment, air pressure is used to return the fluid operated power element in the gas motor to its starting position.

One difficulty with gas powered chemical injector pumps that will soon become apparent relates to the venting of the gas used to drive the pump. When compressed air is used, there is no objection. Objections are beginning to mount where natural gas is vented, in other situations, in large quantities into the atmosphere. One of the desireable features of this invention is that the natural gas which exhausts from the injectors is, or can be, at sufficiently high pressures to be accumulated and reclaimed, either as fuel or in a low pressure gathering line. What this means is that chemical injectors which vent power gas to the atmosphere are probably on their way out, to be replaced by chemical injectors which can deliver exhaust gas at a reasonable pressure to a gas recovery system.

It is an object of this invention to provide an improved chemical injector pump.

Another object of this invention is to provide an improved chemical injector pump which uses higher pressure gas to drive the gas motor.

Other objects and advantages of this invention will become more fully apparent as this description proceeds, reference being made to the accompanying drawings and appended claims.

IN THE DRAWINGS

FIG. 4 is a cross-sectional view of the low pressure switching valve of this invention;

FIG. 7 is a view illustrating another embodiment of this invention.

Figure 1:
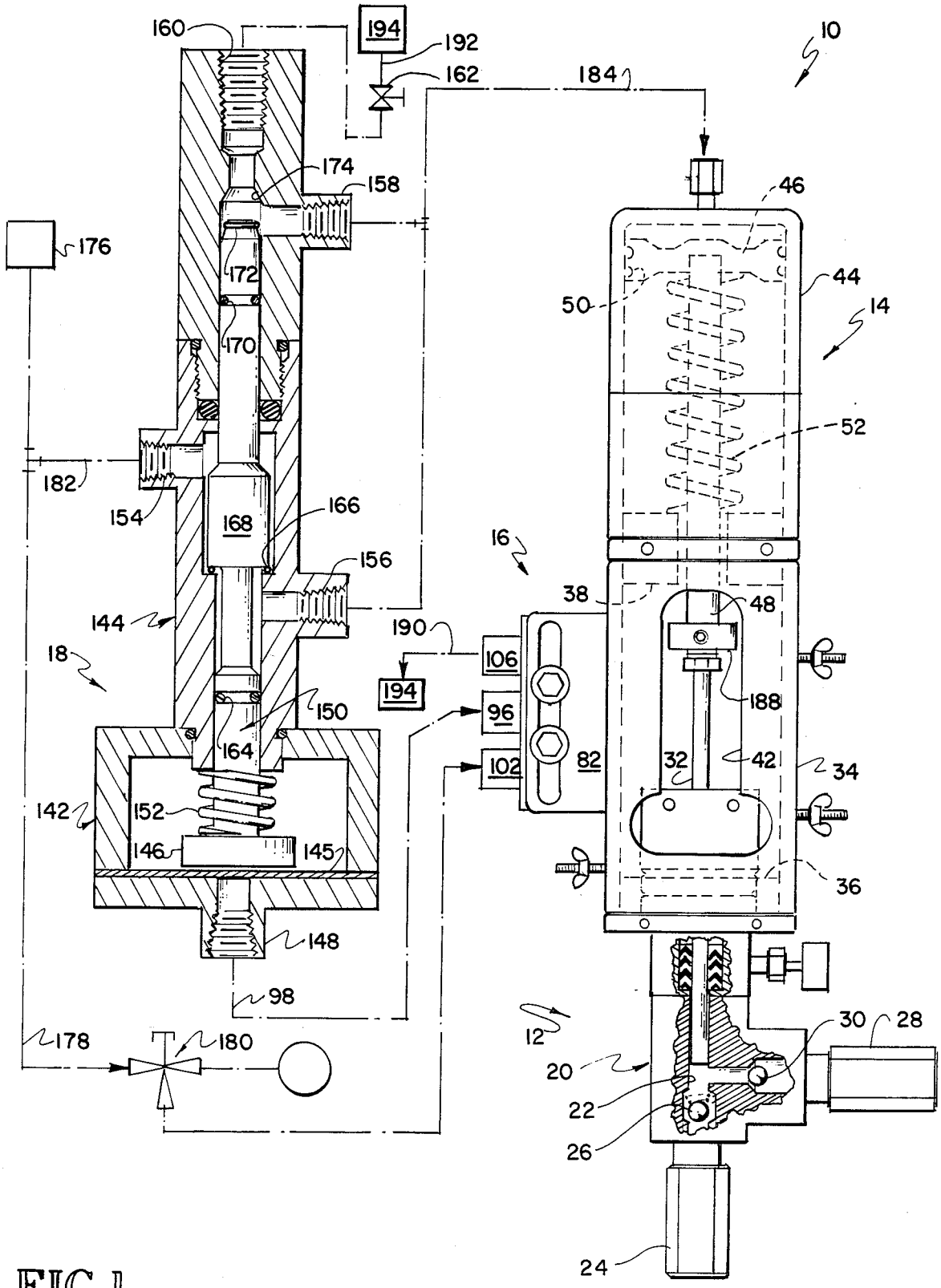
FIG. 1 is a view, partly in section and partly in schematic, of a first embodiment of the chemical injector pump of this invention.

Referring to FIG. 1, a chemical injector pump 10 of this invention comprises, as major components, a liquid pump end 12, a gas motor end 14, a first position responsive low pressure valve 16 and a second pilot operated high pressure valve 18. The low pressure valve 16 senses the position of the pump 12 or motor 14 at the start of a cycle of operation and delivers low pressure gas to the valve 18 to manipulate the valve 18. The valve 18 then delivers high pressure gas to the gas motor 14 to drive it and consequently the pump 12 in the power stroke. The valve 16 senses when the pump 12 or motor 14 reaches its limit in the power direction and manipulates the valve 18 to exhaust high pressure gas from the motor 14 to allow the motor 14 to return to its starting position. Because high pressure gas is delivered to the gas motor 14, the force developed by the motor 14 is increased substantially which increases the pressure capacity of the liquid pump end 12. By using conventional components for the liquid pump end 12 and gas motor 14, a prototype has been assembled which will deliver liquid from the pump end at 20,000 psi using gas pressure of 130 psi as the power fluid to the motor end 14.

The liquid pump end 12 is of conventional design and includes a housing 20 providing a liquid chamber 22, a low pressure liquid inlet 24 having a check valve 26 therein, a high pressure liquid outlet 28 having a check valve 30 therein, and a reciprocating plunger 32 extending into the liquid chamber 22. As will be more fully apparent hereinafter, withdrawal of the plunger 32 from the liquid chamber 22 causes low pressure liquid to enter the inlet 24. Movement of the plunger 32 into the liquid chamber 22 raises the pressure therein causing liquid movement past the check valve 30 and out of the outlet 28. As will be appreciated by those skilled in the art, the liquid pump end 12 is illustrative of conventional high pressure, low volume liquid pump ends of the type typically used in chemical injector pumps.

Preferably, the liquid pump end 12 threadably connects to a frame 34 having an internally threaded lower end 36, an internally threaded upper end 38 and a pair of longitudinally extending supports 40 defining a pair of elongate windows 42 therebetween providing access to the inside of the frame 34.

Threaded onto the upper end 38 of the frame 34 is the gas motor 14, comprising a cylinder 44 having a piston 46 therein and an output rod 48 connected to the piston 46, extending through the frame 34 and connected to the plunger 32 of the liquid pump end 12. The piston 46 preferably includes a pair of spaced O-rings 50 providing a seal against the inside of the cylinder 44. The gas motor 14 is illustrated to be of the single acting type having a spring 52 returning the piston 46 to its upper or retracted position relative to the pump end 12.

Figure 2:
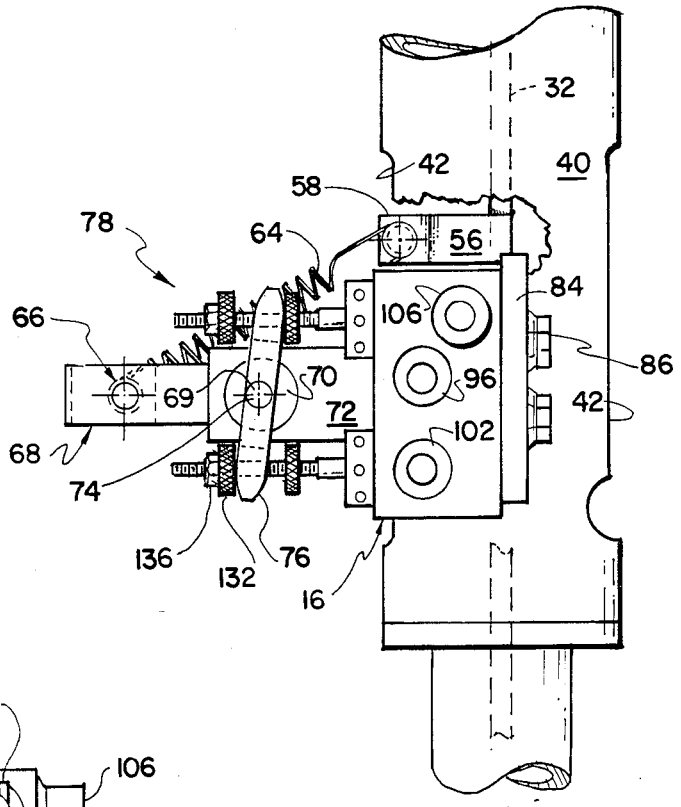
FIG. 2 is a side view of the pump of FIG. 1 illustrating the low pressure switching valve.
Figure 3:
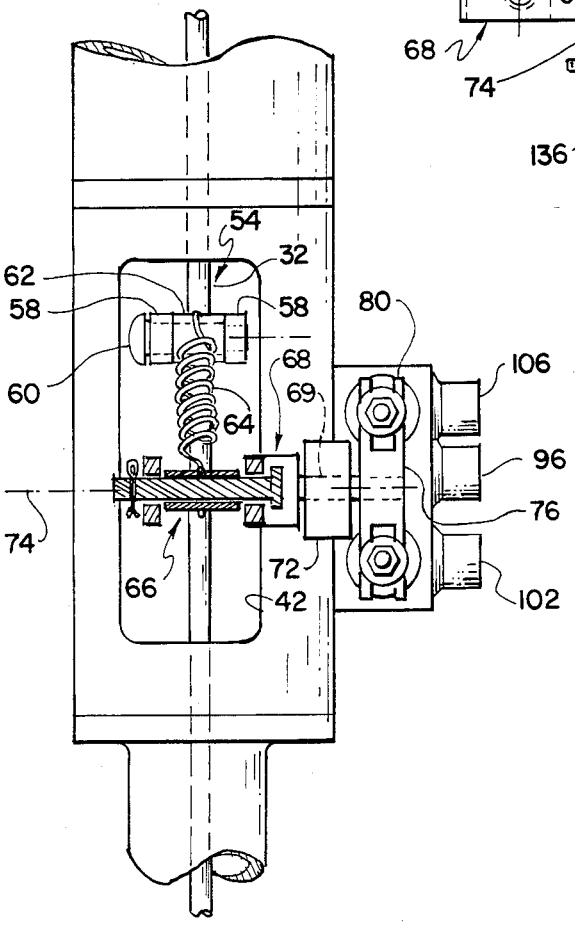
FIG. 3 is a back view of the pump of FIGS. 1 and 2, illustrating the connection between the pump rod and the low pressure switching valve.

Referring to FIGS. 2 and 3, the first valve 16 and means 54 connecting the valve 16 to the pump rod 32 are illustrated in greater detail. The connecting means 54 includes an arm 56 attached to the pump rod 32 and having a forked end 58 receiving a machine screw 60 therethrough. A sleeve 62 is captivated by the screw 60 and the forked end 58 and provides a connection to a conventional helical spring 64. The opposite end of the spring 64 is attached by a similar connecting means 66 to a rocker arm or crank assembly 68 having a shaft 69 mounted by a bearing 70 on a post 72 for rotation about an axis 74. Rigid with the rocker arm assembly 68 is an actuating arm 76 which alternately pulls and pushes on a pair on linearly movable valve actuating assemblies 78. As shown best in FIG. 3, the actuating arm 76 includes a pair of slotted or U-shaped ends 80 receiving the assemblies 78.

When the piston rod 48 is fully retracted, as shown in FIGS. 1-3, the spring 64 has pulled the rocker arm 68 to its uppermost position which manipulates the valve 16 to begin delivering power air to the air motor 14. When the piston rod 48 and the pump rod 32 approach the lower limit of the power stroke, the arm 56 is correspondingly lowered so that spring 64 becomes downwardly inclined relative to the rocker arm 68. Much like an over-center toggle, the spring 64 pulls the rocker arm 68 about its axis 74 thereby rotating the rocker arm 68 and its actuating arm 76 to a position which manipulates the valve 16 to begin venting air from the cylinder 44 allowing the air motor 14 to begin retracting.

The valve 16 comprises a housing 82 which is desirably connected to the frame 34 and includes an open side closed by a closure 84 including one or more threaded fasteners 86 securing the closure 84 to the housing 82. As shown best in FIG. 4, the housing 82 comprises a block of material having a pair of generally parallel linear valving passages 88, 90 extending thereinto. The bottoms of the passages 88, 90 communicate through much smaller passages 92, 94 with a common port 96 connected by a conduit 98 to the pilot operated valve 18 as will be more fully explained hereinafter. A passage 100 communicates between an inlet port 102 and an intermediate portion of the passage 88. Similarly, a passage 104 communicates between a bleed port 106 and an intermediate portion of the passage 90.

A pair of substantially identical linearly reciprocable valve members 108 are located in the valving passages 88, 90 and include a stem and seat member 110 having an O-ring 112 thereon for sealing engagement with a frustoconical sealing surface 113 of the valving passages 88, 90. The members 110 are connected to a valve rod 114 having a spring 116 therearound which acts to bias the rod 114 away from a sealing connection 118 having an O-ring seal 120 preventing loss of fluid through the connection 118. Additional sealing O-rings 122 seal around the exterior of the valve rod 114 as it exits through the connection 118. It will accordingly be seen that reciprocation of the valve rod 114 causes the sealing O-ring 112 to move away from the sealing surface 113 to selectively communicate the port 96 with inlet pressure through the inlet port 102 and with the atmosphere through the vent or bleed port 106.

It will thus be seen that the valve and seat member 110 moves for a very short distance, e.g. $\frac{1}{8}$-$\frac{1}{4}$ inch, between its closed and open positions. Thus, the valving action of the valve and seat member 110 is very abrupt.

Each of the actuating assemblies 78 includes an inner stop 128, 130 and an outer stop 132, 134. Preferably, the stops 128, 130, 132, 134 are adjustably mounted on the valve rods 114, as by threading the outer end of the valve rod 114 and threadably advancing the stops 128, 130, 132, 134 to a desired position. A retaining nut 136, 138 is threaded onto the end of the valve rods 114.

As shown in FIG. 4, the valve rod 114 has been raised so the O-ring 112 is $\frac{1}{8}$ inch above the frustoconical valving surface or seat 113 so that control air enters through the port 102, moves through the passage 100, the opening 124 and the passage 92 to exit through the port 95 to pass into the conduit 98 and ultimately into the pilot operated valve 18. Thus, in the position of FIG. 4, the left valve member 108 is initiating the power stroke of the air motor 14 while the right valve member 108 is closed. Of substantial interest is that the spring 116 of the valve members 108 is not sufficient to hold the valve seat members 110 in their closed position. When the helical spring 64 pulls the arm 76 downwardly, the force of the spring 74 pushes the arm 76 against the stops 130, 132 to push the valve and seat member 110 against the seats 113. Thus, the valve members 108 are closed at least partially by the valve actuating spring 64.

When the piston rod 48 or pump rod 32 nears the end of its power stroke, the over-center spring 64 pulls the rocker arm assembly 64 to rotate the actuating arm 76 in a counterclockwise direction indicated in FIG. 4 by the arrow 140. As the actuating arm 76 moves away from the stop 132, the spring 116 shifts the valve stem 110 in the valving passage 88 against the seat 113 to terminate the delivery of control air to the port 96. Thus, the valve 16 is of the close-before-open type.

Continued rotation of the actuating arm 76 causes one end of the actuating arm 76 to contact the stop 128 and push the valve rod 114 to its lowermost position in the valving passage 88. Simultaneously, the opposite end of the actuating arm 76 comes into contact with the stop 134 thereby beginning to pull the valve rod 114 out of the valving passage 90 to move the O-ring 112 away from its seat 113 to allow communication of the passage 94 with the opening 126. Thus, control air enters through the port 96, moves through the passage 94 and the valving passage 90 and exits through the passage 104 and vent port 106.

Referring back to FIG. 1, it will be seen that manipulation of the switching valve 16 cyclically and periodically connects the outlet port 96 with the pilot operated valve 18 thereby periodically operating the valve 18. The valve 18 includes a diaphragm housing 142 and a valve housing 144 connected thereto. Inside the housing 142 is a diaphragm 145 positioned to push an abutment 146 upwardly. Delivery of air into the inlet 148 raises the diaphragm 145 and abutment 146 and thereby shifts a valve spool 150 connected thereto from a normal position venting the air cylinder 44 to a position delivering power air thereto. When the supply of air to the housing 142 is terminated by the switch 16, a spring 152 shifts the valve spool 150 toward a normal position venting the air cylinder 44.

To these ends, the valve housing comprises a power air or gas inlet 154, a power air or gas outlet 156, a vent inlet 158 and a vent outlet 160 having a needle valve 162 therein for controlling the rate that power fluid exhausts from the cylinder 44 to thereby control the speed or rate of the pump 10. The valve spool 150 includes a first sealing member or O-ring 164 which prevents leakage into the piston cylinder 142, a second sealing member or O-ring 166 which seals against an enlargement 168 on the valve spool 150 when the spool 150 is in its downward or venting position, a third sealing member or O-ring 170 which prevents communication between the power gas and the venting gas, and a fourth sealing member or O-ring 172 which moves toward and away from a valve seat 174 to control venting of gas from the air cylinder 44.

As seen in FIG. 1, pressurized gas from a regulated 200 psig source 176 is delivered through a conduit 178 to a regulator 180 connected to the inlet port 102 of the switching valve 16. A branch line 182 connects the conduit 178 to the pilot operated valve 18 while a common conduit 184 connects the power gas outlet 156 and the vent inlet 142 to the inlet 186 of the air motor 14. When the valve 16 is manipulated by the actuating arm 76 to shift the assemblies 78, control air is delivered to the pilot valve 18 to deliver power air through the line 184 to the air cylinder 44. When the piston rod 48 or the pump rod 32 reaches the limit of its power stroke, the switching valve 16 trips to exhaust control air from the pilot valve 18 through the port 106 of the switching valve 16. This allows the spring 152 to retract the valve spool 150 terminating power gas delivery to the air motor 14 and starting the venting of exhaust gas through the conduit 184 and the bleed off valve 162. The needle valve 162 can be opened or pinched off to control the rate of gas exhausting therethrough which controls the rate of movement of the piston 46 and thereby the rate of chemical delivered through the pump end 12.

The chemical injection pump 10 of FIGS. 1–4 has a number of advantages over injection pumps of the prior art. By using relatively high pressure power gas from the source 176, the air motor 14 generates sufficient force to drive the liquid pump 12 to deliver liquid chemical against substantial back pressures. This is accomplished with equipment of minimum size and few wearing parts. A prototype of the embodiment of FIGS. 1–4 operated for several months and several million cycles before requiring repair, which was limited to the replacement of the various O-ring seals in the valves 16, 18.

In addition, the chemical injector 10 is of outstanding flexibility. Pump ends 12 of various size, i.e. various plunger size, are readily attached to the frame 34 merely by threading onto the lower end thereof and attaching the pump rod 32 to the piston rod 48 with a conventional coupling 188. Thus, it is a simple matter to provide injectors of a wide range of volumetric capacity. Similarly, power cylinders of different diameter can be threaded onto the upper end of the frame 34 to provide injectors of greater or lesser pressure capacity.

Another important feature of the injector 10 of this invention is that it operates at pressures which are sufficiently high so that the power fluid and/or the control fluid can be recovered rather than vented. To this end, a conduit 190 connects to the exhaust port 106 of the valve 16 and a conduit 192 connects to the bleed off valve 162. The conduits 190, 192 lead to a gas reclamation system 194, such as a compressor or fuel burning device near the injector pump 10.

Figure 5:
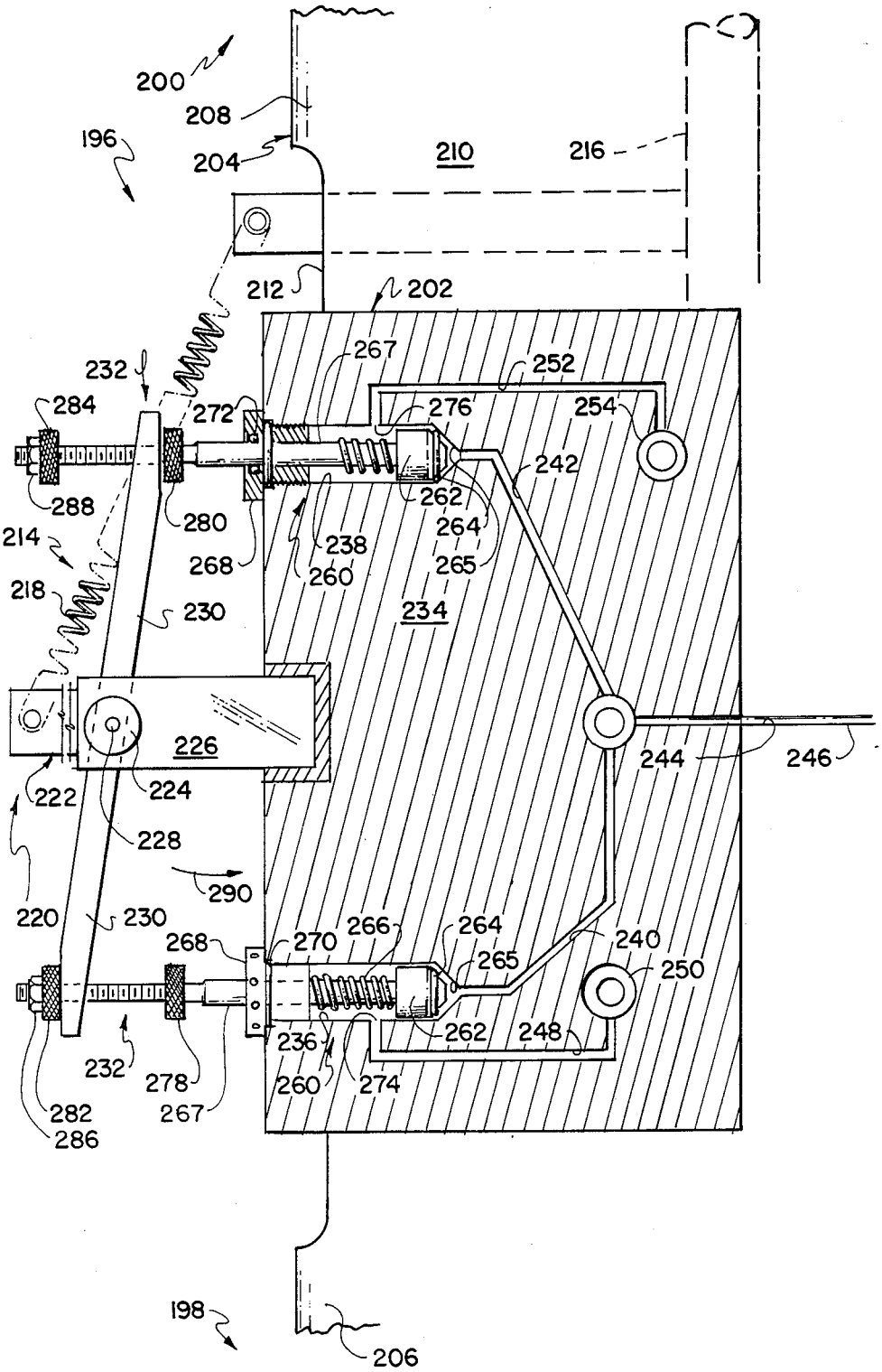
FIG. 5 is a largely schematic view illustrating a second embodiment of this invention.

Referring to FIG. 5, another embodiment of a chemical injector pump 196 of this invention comprises, a major components, a liquid pump end 198, a gas motor end 200 and a position responsive high pressure valve 202. The valve 202 senses the position of the pump or motor at the start of a cycle of operation and delivers high pressure gas directly to the gas motor end 200 thereby eliminating the pilot operated valve 18 in the embodiment of FIGS. 1–4.

Because high pressure gas is delivered to the gas motor 200, the force developed by the motor 200 is increased substantially which increases the pressure capacity of the liquid pump end 198. By using conventional component for the liquid pump end 198 and gas motor 200, a prototype has been assembled which will deliver liquid from the pump end at 20,000 psi using gas pressure of 130 psi as the power fluid to the motor end 200.

The liquid pump end 198 is of conventional design and may be substantially as previously described. Preferably, the liquid pump end 198 threadably connects to a frame 204 having an internally threaded lower end 206, an internally threaded upper end 208 and a pair of longitudinally extending supports 210 defining a pair of elongate windows 212 therebetween providing access to the inside of the frame 204. Threaded onto the upper end 208 of the frame 204 is the gas motor 200 which may be of the single acting type substantially as previously described in the embodiment of FIGS. 1–4.

Means 214 are provided for connecting the valve 202 to the pump rod 216 substantially as shown in FIGS. 2 and 3 and include a conventional helical spring 218. The opposite end of the spring 218 is attached by a similar connecting means 220 to a rocker arm or crank assembly 222 mounted by a bearing 224 on a post 226 for rotation about an axis 228. Rigid with the arm 222 is an actuating arm 230 which alternately pulls and pushes on a pair of linearly movable valve actuating assemblies 232.

When the pump rod 216 is fully retracted, the spring 218 has pulled the rocker arm 222 to its uppermost position which manipulates the valve 202 to begin delivering power air to the air motor 200. When the pump rod 216 and its associated piston rod approach the lower limit of the power stroke, the spring 218 becomes downwardly inclined relative to the rocker arm 222. Much like an over-center toggle, the spring 218 pulls the rocker arm 222 about its axis 228 thereby rotating the rocker arm 222 and its actuating arm 230 to a position which manipulates the valve 202 to begin venting air from the gas motor 200 allowing the motor 200 to begin retracting.

The valve 202 is preferably identical to the valve 16 and comprises a housing 234 which is desirably connected to the frame 204 and includes an open side closed by a closure (not shown) having one or more threaded fasteners (not shown) securing the closure to the housing 234. The housing 234 comprises a block of material having a pair of generally parallel linear valving passages 236, 238 extending thereinto. The bottoms of the passages 236, 238 communicate through much smaller passages 240, 242 with a common port 244 connected by a conduit 246 to the gas motor 200 as will be more fully explained hereinafter. A passage 248 communicates between an inlet port 250 and an intermediate portion of the passage 236. Similarly, a passage 252 communicates between a bleed port 254 and an intermediate portion of the passage 238.

A pair of substantially identical linearly reciprocable valve members 260 are located in the valving passages 236, 238 and include a stem and seat member 262 having an O-ring 264 thereon for sealing engagement with the inner surface of the valving passages 236, 238. The members 260 are connected to a valve rod 267 having a spring 266 therearound which acts to bias the rod 267 away from a sealing connection 268 having an O-ring seal 270 preventing loss of fluid through the connection 268. Additional sealing O-rings 272 seal around the exterior of the valve rod 267 as its exits through the connection 268. It will accordingly be seen that reciprocation of the valve rod 267 causes the sealing O-ring 264 to move off its valve seat 265 to selectively communicate the port 244 with inlet pressure through the inlet port 250 and with the atmosphere through the vent or bleed port 254.

Each of the actuating assemblies 232 includes an inner stop 278, 280 and an outer stop 282, 284. Preferably, the stops 278, 280, 282, 284 are adjustably mounted on the valve rods 267, as by threading the outer end of the valve rod 267 and threadably advancing the stops 278, 280, 282, 284 to a desired position. A retaining nut 286, 288 is threaded onto the end of the valve rods 267.

As shown in FIG. 5, the valve rod 267 has been raised so the O-ring 262 has moved away from its seat 265 so that power air enters through the port 250, moves through the passage 248, the opening 274 and the passage 240 to exit through the port 244 to pass into the conduit 246 and ultimately into gas motor 200. Thus, in the position of FIG. 5, the valve 202 in initiating the power stroke of the air motor 200. When the pump rod 216 or its associated piston rod nears the end of its power stroke, the over-center spring 218 pulls the rocker arm assembly 222 to rotate the actuating arm 230 in a counterclockwise direction indicated in FIG. 5 by the arrow 290. As the actuating arm 230 moves away from the stop 282, the spring 266 shifts the valve stem 262 in the valving passage 236 away from its seat 265 to terminate the delivery of power air to the port 244. Thus, the valve 202 is of the close-before-open type.

Continued rotation of the actuating arm 230 causes one end of the actuating arm 230 to contact the stop 278 and push the valve rod 267 to its lowermost position in the valving passage 236. Simultaneously, the opposite end of the actuating arm 230 comes into contact with the stop 284 thereby beginning to pull the valve rod 267 out of the valving passage 238 to move the O-ring 264 from engagement with its seat 265 to a position out of sealing engagement therewith to allow communication of the passage 242 with the opening 276. Thus, power air enters through the port 250, moves through the passage 248 and the valving passage 236 and exits through the passage 240 and vent port 244.

It will be seen that manipulation of the switching valve 202 cyclically and alternately connects the outlet port 244 with the power air inlet 250 and with the vent port 254 thereby causing the air motor 200 to alternately extend on the power stroke and retract and thereby cyclically operate. It will be seen that the embodiment of FIG. 5 is substantially identical with the embodiment of FIGS. 104 except that the pilot operated valve 18 has been deleted without eliminating any of the functions thereof, i.e. the gas motor 200 operates substantially like the gas motor 14.

Figure 6:
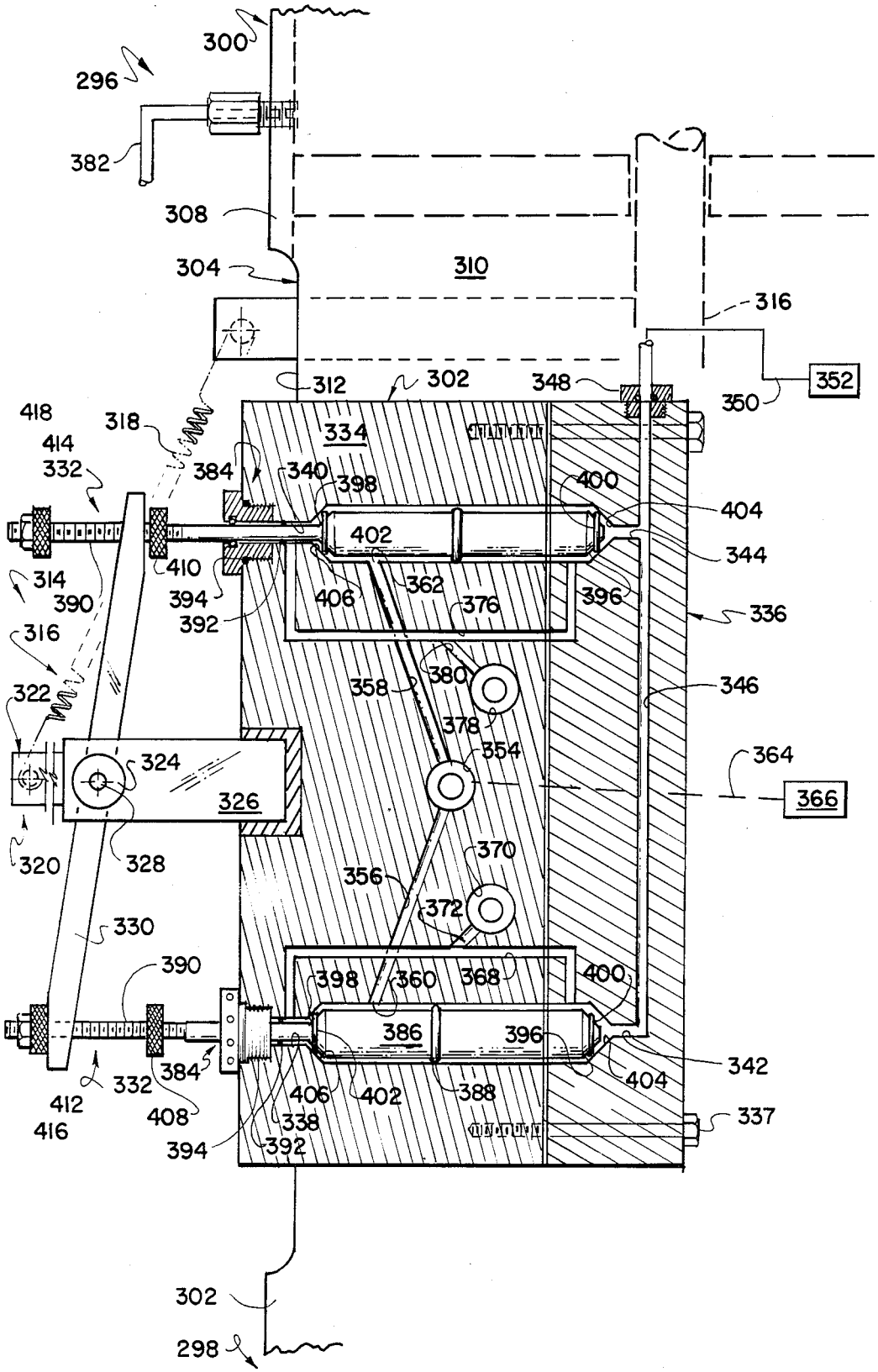
FIG. 6 is another largely schematic view illustrating a modification of the second embodiment of this invention.

Referring to FIG. 6, another embodiment of a chemical injector pump 296 of this invention comprises, as major components, a liquid pump end 298, a gas motor end 300 and a position responsive high pressure valve 302. The valve 302 senses the position of the pump or motor at the start of a cycle of operation and delivers high pressure gas directly to the gas motor end 300.

Because high pressure gas is delivered to the gas motor 300, the force developed by the motor 300 is increased substantially which increases the pressure capacity of the liquid pump end 298. By using conventional components for the liquid pump end 298 and gas motor 300, a prototype has been assembled which will deliver liquid from the pump end at 20,000 psi using gas pressure of 130 psi as the power fluid to the motor end 300.

The liquid pump end 298 is of conventional design and may be substantially as previously described. Preferably, the liquid pump end 298 threadably connects to a frame 304 having an internally threaded lower end 306, an internally threaded upper end 308 and a pair of longitudinally extending supports 310 defining a pair of elongate windows 312 therebetween providing access to the inside of the frame 304. Threaded onto the upper end 308 of the frame 304 is the gas motor 300 which is of the double acting type, rather than the single acting type described in the embodiments of FIGS. 1–5.

Means 314 are provided for connecting the valve 302 to the pump rod 316 substantially as shown in FIGS. 2 and 3 and include a conventional helical spring 318. The opposite end of the spring 318 is attached by a similar connecting means 320 to a rocker arm or crank assembly 322 mounted by a bearing 324 on a post 326 for rotation about an axis 328. Rigid with the arm 322 is an actuating arm 330 which alternately pulls and pushes on a pair of linearly movable valve actuating assemblies 332.

When the pump rod 316 is fully retracted, the spring 318 has pulled the rocker arm 322 to its uppermost position which manipulates the valve 302 to begin delivering power air to the air motor 300. When the pump rod 316 and its associated piston rod approach the lower limit of the power stroke, the spring 318 becomes downwardly inclined relative to the rocker arm 322. Much like an over-center toggle, the spring 318 pulls the rocker arm 322 about its axis 328 thereby rotating the rocker arm 322 and its actuating arm 330 to a position which manipulates the valve 302 to begin venting air from the gas motor 300 allowing the motor 300 to begin retracting.

The valve 302 comprises a housing segment 334 which is desirably connected to the frame 304 and a removable housing segment 336 having one or more threaded fasteners 337 securing the segments 334, 336 together. The segment 334 comprises a block of material having a pair of generally parallel linear valving passages 338, 340 extending thereinto. The outside ends of the passages 338, 340, adjacent the actuating assemblies 332, are somewhat smaller than the intermediate portion thereof. The inside ends of the passages 338, 340 extend into the housing segment 336 and communicate through much smaller passages 342, 344, 346 with a common port 348 comprising a vent. As in the embodiments of FIGS. 1–5, one of the features of this invention is the capability of reclaiming exhaust power gas. To this end, The port 348 is connected by a conduit 350 to a gas recovery system 352.

The housing segment 334 includes a high pressure inlet port 354 connected by passages 356, 358 to an opening 360, 362 located intermediate the ends of the valving passages 338, 340. The high pressure port 354 is connected by a conduit 364 to a regulator 366 delivering high pressure gas above about 100 psig and preferably above about 130 psig.

The opposite ends of the valving passage 338 are connected by a conduit 368 which communicates with an outlet port 370 through a branch conduit 372. The outlet port 370 connects to the power end of the gas motor 300 through a conduit (not shown) to deliver high pressure air to the motor 300 during the power stroke and to exhaust air from the motor 300 during the retraction part of the power cycle. Similarly, the opposite ends of the valving passage 340 are connected by a conduit 376 which communicates with an outlet port 378 through a branch conduit 380. The outlet port 378 connects to the retraction end of the gas motor 300 through a conduit 382 to exhaust air from the motor 300 during the power stroke and to supply high pressure air to the motor 300 during the retraction part of the power cycle.

A pair of substantially identical linearly reciprocable valve member 384 are located in the valving passages 338, 340 and include a stem and seat member 386 having a central O-ring seal 388 thereon for sealing engagement with the inner surface of the valving passages 338, 340. The member 386 are connected to a valve rod 390 having an O-ring seal 392 preventing loss of fluid through a connection 394. The opposite ends of the stem and seat member 386 include tapered sections 396, 398 having O-ring seals 400, 402 carried thereon to seal against the tapered sections 404, 406 of the valving passages 338, 340.

It will accordingly be seen that reciprocation of the valve rod 390 causes the sealing O-ring 400 to move alternately into and out of sealing engagement with its tapered seat 404 to periodically communicate the port 370 with the vent passage 342. At the same time, reciprocation of the valve rod 390 causes the sealing O-ring 402 to move alternately into and out of sealing engagement with its tapered seat 406 to periodically communicate the port 370 with the air supply passage 356. Thus, reciprocation of the rod 390 delivers power air to the conduit 374 when the O-ring 404 is out of engagement with its seat 406 and, because the O-ring 400 is in engagement with its seat 404, prevents simultaneous venting of power air. When the valve rod 390 is fully retracted, the O-ring 402 prevents power air from moving to the port 370 and the motor 300 while air is being exhausted through the port 370 and passage 342.

Operation of the valve member 384 and its valving passage 340 is substantially the same. When the O-ring 402 is out of engagement with the seat 406, high pressure air moves from the port 354 to the passage 376 and then to the port 378 to the motor 300 to retract the piston thereof. At this time, the O-ring 400 is engaged against its seat 404 to prevent power air from venting. When the valve rod 390 is fully retracted in the valving passage 340, the O-ring 400 is away from its seat 404 thereby allowing air from the port 378 and thus from the retraction side of the motor 300 to exhaust through the passage 344 and port 348.

Each of the actuating assemblies 332 includes an inner stop 408, 410 and an outer stop 412, 414. Preferably, the stops 408, 410, 412, 414 are adjustably mounted on the valve rods 390, as by threading the outer end of the valve rod 390 and threadably advancing the stops 408, 410, 412, 414 to a desired position. A retaining nut 416, 418 is threaded onto the end of the valve rods 390.

Referring to FIG. 7, there is illustrated another embodiment of this invention comprising a master unit 420 comprising, as major components, a gas motor end 422, a liquid end 424, a switching valve 426 and a plurality of slave units 428 comprising, as major components, a gas motor end 430 and a liquid end 432. The master unit 420 may be of any suitable type and is illustrated as substantially the same as the chemical injection pump 196 in that the gas motor 422 is of the single acting type and the valve 426 acts to deliver power air to and from the gas motor 422 through a conduit 434 and vent exhaust air through a needle valve 436.

The power gas connection 438 to the gas motor 422 is a tee, preferably in the side of the gas motor 422, leading to a branch conduit 440 communicating with a fitting 442 in the gas motor 430. The branch conduit 440 includes another branch 444 leading to one or more additional slave units (not shown). It will accordingly be seen that movement of the piston rod 446 in a retracting direction to the limit of its travel trips the switching valve 426 to stop the venting of power gas through the needle valve 436 and commence delivery of power gas through the conduit 434 to both of the gas motors 422, 420. Thus, both gas motors 422, 430 begin to move in the power direction thereby delivering high pressure liquid through the liquid ends 424, 432. It will be evident that the liquids ends 424, 432 may have their inlets connected to the same liquid supply or be pumping different liquids as the occasion requires.

The volume pumped by the master unit 420 is controlled by manipulating the needle valve 436 and controlling the rate of exhaust of power gas from the gas motor 422, as in the other embodiments of the invention. Because the slave units 428 cycle at the same rate as the master unit 420, the slave units 428 will deliver the same amount of liquid as the master unit 420, all other things being equal. It is much preferred to provide means for varying the quantity of liquid delivered by the slave units 428 over a range of liquid outputs, as distinguished from merely changing the liquid ends 424, 438.

To this end, the gas motors 422, 430 preferably have an adjustable stop 448, 450 in the end walls 452, 454. The adjustable stops 448, 450 include a fitting 456 secured to the end walls 452, 454 and a thumb screw 458 threaded into the fitting 456. Adjusting the thumb screw 458 advances the end 460 thereof toward and away from the gas motor piston thereby adjusting the stroke of the gas motors 422, 430 and thereby adjusting the stroke of the liquid ends 424, 432. Because both of the gas motors 422, 430 have the adjustable stops 448, 450, it will be seen that the liquid output of the master unit 430 may be more or less than that of the slave units 428, even if the liquid ends 424, 432 are the same size.

Although the invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A chemical injector pump comprising a liquid pump including a reciprocating plunger for forcing liquid out of the pump;

a fluid motor including a housing having an inlet, a fluid operated member in the housing exposed to the inlet, an output rod driven by the fluid operated member between first and second positions and connected to the reciprocating plunger for moving the plunger in response to the delivery of pressurized fluid to the housing inlet;

a valve having a housing providing a linear valving passage extending thereinto, the valving passage having a valve seat at the end thereof and a fluid passage opening into the valve seat, an inlet for connection to a source of pressurized fluid at a predetermined pressure, an outlet connected to the housing inlet, a reciprocating valve member linearly shiftable between first and second positions for selectively communicating the valve inlet with the valve outlet, the reciprocating valve member having an O-ring seal on the end thereof for alternately sealably engaging the valve seat and blocking fluid flow through the fluid passage and being spaced from the valve seat allowing fluid flow through the fluid passage; and a valve rod extending out of the valve housing and first and second spaced stops carried by the valve rod; and means sensing the first and second positions of the output rod for manipulating the valve member including a support, a crank rotatably mounted on the support having a first crank end comprising a rocker arm having a section positioned to engage the first and second valve stops for alternately pulling and pushing on the valve rod for shifting the valve member between the first and second positions and a second crank end, and an over-center spring connected to the second crank end and the output rod for rotating the crank as the output rod approaches its first and second positions.

2. The chemical injector of claim 1 comprising means for biasing the reciprocating valve member toward sealing engagement with the valve seat when the valve member is engaged therewith, the biasing means including the over-center spring.

3. The chemical injector pump of claim 1 wherein the fluid motor fluid member comprises a piston movable in a power stroke from the first to the second position and a spring biasing the piston from the second position back to the first position.

4. The chemical injector pump of claim 1 wherein the fluid motor fluid member comprises a piston movable in a power stroke from the first to the second position from pressurized fluid delivered through the housing inlet and wherein the motor housing includes a second inlet for delivering pressurized fluid to the piston for moving the piston from the second position to the first position, the valve comprises a second outlet connected to the fluid motor housing second inlet.

5. The chemical injector pump of claim 1 further comprising a valve spring biasing the reciprocating valve member toward engagement with the valve seat.

6. The chemical injector pump of claim 5 wherein the valve spring is located inside the linear valving passage.

7. The chemical injector pump of claim 1 wherein the valve housing comprises a second linear valving passage extending thereinto, the second valving passage having a second valve seat at the end thereof and a second fluid passage opening into the second valve seat, the second reciprocating valve member having a second O-ring seal on the end thereof for alternately sealably engaging the second valve seat and blocking fluid flow through the second fluid passage and being spaced from the second valve seat allowing fluid flow through the second fluid passage and a second valve spring biasing the second reciprocating valve member toward engagement with the second valve seat.

8. The chemical injector pump of claim 7 wherein the second fluid passage connects to a part having a valve therein for controlling the speed of the fluid motor and further comprising a fluid recovery system and a conduit connected between the port and the fluid recovery system for reclaiming the fluid delivered to the fluid motor.

9. The chemical injector pump of claim 1 further comprising a second liquid pump including a second reciprocating plunger for forcing liquid out of the second pump; a second fluid motor including a second housing having a second inlet, a second output rod driven by the second fluid operated member between first and second positions and connected to the second reciprocating plunger for moving the second plunger in response to the delivery of pressurized fluid to the second housing inlet; the second fluid motor inlet being connected to the outlet of the valve for driving the second fluid motor contemporaneously with the first mentioned fluid motor.

10. The chemical injector pump of claim 9 further comprising means for simultaneously controlling the speed of the first and second fluid motors and means for independently controlling the output of the first and second liquid pumps.

11. A chemical injector pump comprising a liquid pump including a reciprocating plunger for forcing liquid out of the pump;

a fluid motor including a housing having an inlet, a fluid operated member in the housing exposed to the inlet, an output rod driven by the fluid operated member between first and second positions and connected to the reciprocating plunger for moving the plunger in response to the delivery of pressurized fluid to the housing inlet;

a valve having a housing providing a linear valving passage extending thereinto, the valving passage having a frustoconical valve seat at the end thereof and a fluid passage opening into the frustoconical valve seat, an inlet for connection to a source of pressurized fluid at a predetermined pressure, an outlet connected to the housing inlet, a reciprocating valve member linearly shiftable between first and second positions for selectively communicating the valve inlet with the valve outlet, the reciprocating valve member having an O-ring seal on the end thereof for alternately sealably engaging the frustoconical valve seat and blocking fluid flow through the fluid passage and being spaced from the valve seat allowing fluid flow through the fluid passage and a valve spring biasing the reciprocating valve member toward engagement with the frustoconical valve seat, and a valve rod extending out of the valve housing and first and second spaced stops carried by the valve rod;

means sensing the first and second positions of the output rod for manipulating the valve member including a support, a crank rotatably mounted on the support having a first end comprising a rocker arm having a section positioned to engage the first and second valve stops for alternately pulling and pushing on the valve rod for shifting the member between the first and second positions and a second end, and an over-center spring connected to the second crank end and the output rod for rotating the crank as the output rod approaches its first and second positions.

12. The chemical injector pump of claim 11 wherein the rocker arm is mounted for movement in a predetermined arc and includes a section for engaging the first and second stops, the rocker arm section being out of engagement with the first and second stops during a major portion of the predetermined arc.

13. The chemical injector of claim 12 wherein the rocker arm section comprises a slot receiving the valve rod therein.

14. A chemical injector pump comprising a first liquid pump including a reciprocating plunger for forcing liquid out of the pump;

a first fluid motor including a first housing having a first inlet, a first fluid operated member in the first housing exposed to the first inlet, a first output rod driven by the first fluid operated member between first and second positions and connected to the first reciprocating plunger for moving the first plunger in response to the delivery of pressurized gas to the first inlet;

a valve having an inlet for connection to a source of pressurized gas at a predetermined pressure, an outlet connected to the first housing inlet, a reciprocating valve member linearly shiftable between first and second positions for selectively communicating the valve inlet with the valve outlet; and means sensing the first and second positions of the first output rod for manipulating the valve member including a support, a crank rotatably mounted on the support having a first end operatively connected to the reciprocating valve member for shifting the valve member between the first and second positions and a second end, and an over-center spring connected to the second crank end and the first output rod for rotating the crank as the first output rod approaches its first and second positions;

a second liquid pump including a second reciprocating plunger for forcing liquid out of the second pump;

a second fluid motor including a second housing having a second inlet, a second output rod driven by the second fluid operated member between first and second positions and connected to the second reciprocating plunger for moving the second plunger in response to the delivery of pressurized fluid to the second housing inlet;

the second fluid motor inlet being connected to the outlet of the valve for driving the second fluid motor contemporaneously with the first fluid motor;

means for simultaneously controlling the speed of the first and second fluid motors; and means for independently controlling the output of the first and second liquid pumps.

* * * * *